United States Patent [19]

Driver

[11] 4,303,693

[45] Dec. 1, 1981

[54] METHOD OF APPLYING A CERAMIC COATING TO A METAL WORKPIECE

[75] Inventor: Ronald W. Driver, Clitheroe, England

[73] Assignee: Rolls-Royce Limited, London, England

[21] Appl. No.: 187,405

[22] Filed: Sep. 15, 1980

[30] Foreign Application Priority Data

Sep. 22, 1979 [GB] United Kingdom ..... 32941/79

[51] Int. Cl.[3] ..... B05B 7/22

[52] U.S. Cl. ..... 427/34; 427/318

[58] Field of Search ..... 427/34, 318, 330, 423, 427/422, 319, 46

[56] References Cited

U.S. PATENT DOCUMENTS

| | | | |
|---|---|---|---|
| 3,493,415 | 2/1970 | Grisaffe et al. | 427/318 |
| 3,839,618 | 10/1974 | Muehlberger | 427/34 |
| 4,163,071 | 7/1975 | Weatherly et al. | 427/34 |

*Primary Examiner*—Ralph S. Kendall

*Attorney, Agent, or Firm*—Cushman, Darby & Cushman

[57] ABSTRACT

A method of applying a ceramic coating to a metallic workpiece is proposed in which the workpiece is heated in a range of 500° C. to 950° C. and the coating directly plasma sprayed thereon in an atmosphere of air before the workpiece has formed any considerable oxide skin thereon. In this way the use of the conventional bond coat is avoided, while the amount of tensile stress on the ceramic at working temperature is reduced by the pre-stressing effect thus induced.

8 Claims, 2 Drawing Figures

METHOD OF APPLYING A CERAMIC COATING TO A METAL WORKPIECE

Figure 1:
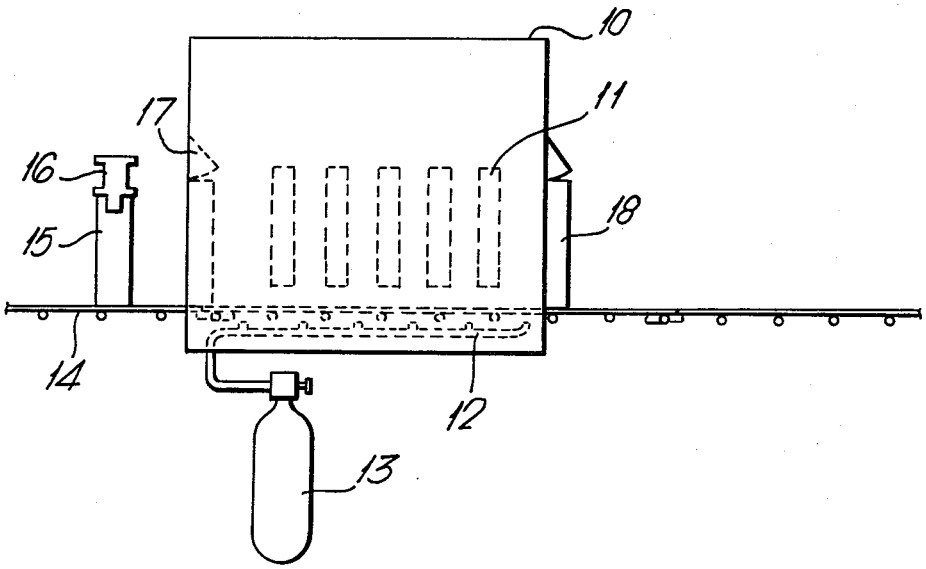

This invention relates to a method of applying a ceramic coating to a metallic workpiece.

It has become increasingly common to consider using ceramic coatings on metallic work-pieces, normally to provide a thermal barrier which prevents excessive heating of the work-piece when it is exposed to hot ambient conditions. One example of an application of these coatings lies in the hot components such as combustion chambers and turbine blades and vanes of a gas turbine engine. These coatings may be applied by a number of methods with plasma spraying being the most commonly used.

One serious problem with coatings of this nature arises because of the relative susceptibility of the ceramic material to tensile loads, and because of the very low coefficient of expansion of the ceramic. It will be understood that if a coating is applied to a metal workpiece and the metal work-piece subsequently heated there will be considerable differential expansion which will put the coating in tension and will be liable to cause the coating to crack and to spall off from the workpiece.

It has been proposed in e.g. British Pat. No. 1384883 to apply a ceramic coating to a hot workpiece. In this way the tensile loads on the coating at working temperature are reduced at the expense of increased compressive loads at low temperature. Because the coating is inherently stronger in compression this is not a serious problem, as is clearly explained in the above mentioned patent. The main difficulty with this technique lies in the method used to attach the coating securely to the hot metal substrate. In the patent a technique is described in which an interlayer or bond coat is used to help the ceramic coat to adhere to the substrate.

We have made the surprising discovery that by using a carefully controlled heating technique a ceramic coating may be applied to a metallic workpiece without the necessity of providing a bond coat or other interlayer.

According to the present invention a method of applying a ceramic coating to a metallic work-piece comprises a heating step in which the work-piece is heated to a temperature above 500° C. in a manner such as to form on the work-piece surface at most a thin and strongly adherent coat of metallic oxides, and a plasma spraying step in which a ceramic coating is sprayed on to the hot work-piece.

Conveniently the heating of the work-piece is carried out by the plasma gun itself operating without a feed of a ceramic material; in this case the argon working gas of the gun serves to prevent the formation of non-adherent oxides on the work-piece surface.

We have found that it is necessary to reduce the effect of the plasma gun on the workpiece during this heating step either by moving the gun further from the work-piece than is normally the case or by reducing the power of the gun itself.

A preferred ceramic material comprises zirconium dioxide stabilised with yttria or with calcium oxide or another suitable stabilising material. The workpiece may comprise a nickel or cobalt base super alloy or stainless steel or zirconium.

In a first example of the invention a workpiece comprising a turbine blade for a gas turbine engine was used. The material from which the blade was produced comprised a cast nickel based super alloy known as Mar M002 whose constituents are well known to those skilled in the art.

The blade was mounted from a support fixture and a plasma spraying gun, which in this instance was a Metco Type 3MB, was used without any feed of ceramic material to heat up the surface of the blade. In heating the blade the gun was removed to a distance of some 6½" or 16.5 cm from the blade surface as compared with the normal spraying distance of 3" or 7.6 cm.

When the blade had reached a temperature estimated at some 600° C. by the appearance of the blade, spraying of the ceramic was commenced. It should be noted that to ensure heating of all the blade surface the blade was rotated about its axis with respect to the gun, so that although that part of the surface being actually heated was protected by the argon working fluid of the gun the reverse surface was subject to normal atmosphere and some surface oxidation inevitably took place.

In order to commence spraying, a feed of mixture of zirconium and yttria powders was switched on. The feed was such as to give 80% zirconium and 20% yttria in the final coating. As is normal in the plasma spraying technique the ceramic powders were entrained in the plasma stream from the gun, melted and caused to impact on the blade surface to form a strong and uniform coating of ceramic.

As mentioned above the normal spraying distance between the gun and the work-piece is 3" or 7.6 cm and this distance was used when applying the ceramic coating.

The metal surface was not cooled during the spraying process and the attained temperature of the metal during the process was largely dictated by the energy input from the plasma process.

After the coating had been layed down it was inspected and found to be firmly adherent to the blade with no signs of an imperfect bond. To demonstrate that the coating was properly adherent to the surface, the blade was tested by thermal cycling between 1000° C. and minus 20° C., subjection to mechanical shock impacts and measurement to show the adhesive strength of the coating was greater than 4600 P.S.I. (30 MPa). The results showed that the coating adhered well to the surface of the workpiece and was not subject to high temperature spallation as were corresponding coatings applied to cold workpieces.

In a second experiment a blade was sprayed with the same coating and using the same parameters, except that in this case the blade was heated to a temperature of approximately 900° C. before the coating was applied. The coated blade was then subjected to a cycle of tests intended to represent the extremes of temperature to which the blade might be subject in operation. It was soaked in water for 12 hours followed by freezing at −16° C. for 24 hours, quenched in boiling water and then rapidly cycled between 1000° C. and 300° C. with a 700° C. temperature gradient across the blade.

The coating was found not to be damaged by this test, which indicates a good adhesion and durability.

We find that in general for satisfactory adhesion the substrate should have a clean surface finish of 60 micro inches for flat surfaces, but that a rather rougher surface finish of 160 micro inches is more appropriate for surfaces which are not flat, such for instance as aerofoils. The coating itself in our tests had a surface finish of 200–300 micro inches which may of course be improved by subsequent polishing.

A further feature of interest in the coatings produced in our test was that when the coating was at or above 950° C., increased strain of the coating produced no increase in stress, i.e. the coating is acting in a quasi-fluid manner. We have in fact calculated the strains in the coating for a variety of ambient conditions and for a range of substrate temperatures at which the coating is applied, and as a result we find that the best balance of properties is achieved using substrate temperature of between 800° C. and 950° C.

It will be understood that in the above examples coatings for blades have been described, but it is apparent that the coating method of the invention could easily be applied to other workpieces and used for other reasons than thermal protection. For instance open celled honeycomb material can be infilled with ceramic using the technique of the invention to enhance abrasion resistance.

Figure 2:
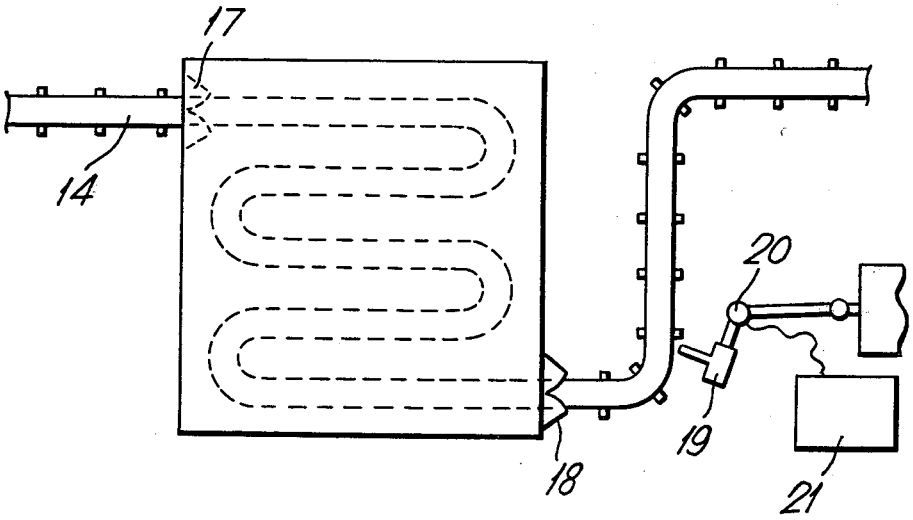

The examples described above comprise experimental tests, but a possible production method is described with reference to the accompanying drawings in which:

FIG. 1 is a side elevation of a furnace and spraying unit for carrying out the method of the invention, and FIG. 2 is a plan view of the furnace and spraying unit of FIG. 1.

In FIG. 1 there is shown a furnace 10 heated by electrical elements 11. Argon feed pipes 12 allow argon gas to flow from bottles 13 to provide an inert atmosphere in the furnace. A conveyor 14 carries a plurality of work stations one of which is shown at 15 carrying a turbine blade workpiece 16. The conveyor carries the stations 15 and blades 16 through airlock doors 17 into the furnace and describes a tortuous path through the furnace to achieve the desired residence time (see FIG. 2).

When the blade has achieved its desired temperature in the range 800° C. to 950° C., it leaves the furnace through exit airlock doors 18. The hot blade is immediately sprayed by a plasma gun 19 with the desired ceramic, the gun 19 being operated by a servomechanism 20 controlled by a microcomputer device 21. The finished coated blades are then off-loaded from the conveyor and any further operations necessary are carried out.

It will be noted that it is most important that the workpieces should not be allowed time to form any considerable oxide coating on their surfaces; hence the requirement for the spraying step to be carried out immediately after the workpieces exit from the furnace.

Although in the above examples an yttria stabilised zirconia coating was used it will be appreciated by those skilled in the art and that there are various alternative ceramic coating systems such as alumina, or tungsten carbide which could be used. Also the stabiliser for the yttria could be one of a number of alternatives such as calcium oxide or magnesium oxide. Also this technique would readily be applicable to other metal materials such as cobalt based superalloys, stainless steels and titanium alloys.

I claim:

1. A method of applying a ceramic coating to a metallic workpiece comprising the steps of:

heating the metallic workpiece to a temperature in a range of 500° C. to 950° C. with at most a thin and strongly adherent coat of metallic oxide forming on the workpiece;

and then before a further oxide coating forms on the heated workpiece, immediately plasma spraying the ceramic coating on to the heated workpiece in an atmosphere of air.

2. A method as claimed in claim 1 and in which said workpiece is heated during the heating step to a temperature in the range 800° C. to 950° C.

3. A method as claimed in claim 2 and in which said heating step is carried out using a plasma gun which is subsequently used to apply said ceramic coating.

4. A method as claimed in claim 3 and in which said heating step is carried out using a plasma gun maintained at a first, greater distance from the workpiece and said plasma spraying step is carried out using the same plasma gun which is moved to a second, lesser distance from the workpiece.

5. A method as claimed in claim 2 and in which said heating step is carried out using a furnace with an inert atmosphere therein.

6. A method as claimed in claim 5 and in which said inert atmosphere comprises argon.

7. A method as claimed in claim 5 or 6 and comprising conveying said workpiece through said furnace in which said heating step takes place and carrying out said plasma spraying step immediately said workpiece emerges from said furnace.

8. A method as claimed in any of claims 1, 2, 3, 4, 5 or 6 and in which said ceramic coating comprises yttria stabilised zirconia.

* * * * *